US010631111B2

(12) United States Patent
Cho et al.

(10) Patent No.: US 10,631,111 B2
(45) **Date of Patent: *Apr. 21, 2020**

(54) VIBRATION TRANSDUCER AND IMPLANTABLE HEARING AID DEVICE

(71) Applicant: Kyungpook National University Industry-Academic Cooperation Foundation, Daegu (KR)

(72) Inventors: Jin-Ho Cho, Daegu (KR); Ki Woong Seong, Daegu (KR); Jyung Hyun Lee, Gyeongsangbuk-do (KR); Hyung Gyu Lim, Daegu (KR); Dong Ho Shin, Daegu (KR)

(73) Assignee: KYUNGPOOK NATIONAL UNIVERSITY INDUSTRY-ACADEMIC CO, Daegu (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/038,518

(22) Filed: Jul. 18, 2018

(65) Prior Publication Data

US 2018/0324533 A1 Nov. 8, 2018

Related U.S. Application Data

(62) Division of application No. 14/644,658, filed on Mar. 11, 2015, now Pat. No. 10,057,696.

(30) Foreign Application Priority Data

Mar. 13, 2014 (KR) ..... 10-2014-0029755

(51) Int. Cl.
*H04R 25/00* (2006.01)
*H04R 9/02* (2006.01)

(52) U.S. Cl.
CPC ..... *H04R 25/606* (2013.01); *H04R 9/025* (2013.01); *H04R 2225/67* (2013.01)

(58) Field of Classification Search
CPC ..... H04R 25/60–609; H04R 2225/67
See application file for complete search history.

(56) References Cited

U.S. PATENT DOCUMENTS 5,282,858 A * 2/1994 Bisch ..... A61F 2/18 381/162
5,797,834 A 8/1998 Goode
(Continued)

FOREIGN PATENT DOCUMENTS

JP H05191893 A 7/1993
KR 100859979 B1 9/2008
(Continued)

OTHER PUBLICATIONS

Nakajima, et al., "Evaluation of Round Window Stimulation Using the Floating Mass Transducer by Intracochlear Sound Pressure Measurements in Human Temporal Bones", Otol Neurotol. Apr. 2010 ; 31(3): 506-511.

*Primary Examiner* — Thaddeus B Cox
(74) *Attorney, Agent, or Firm* — Carter, DeLuca & Farrell LLP

(57) ABSTRACT

Provided are a vibration transducer and an implantable hearing aid device. In one embodiment, the implantable hearing aid device includes a signal processing part implantable in a subject, the signal processing part processing a signal from a microphone to output a sound signal, a sound transmission tube configured for transmitting the sound signal to a round window of the subject, and a bellows member disposed at an end side of the sound transmission tube to transmit vibration due to the sound signal to the round window. In other embodiment, the implantable hearing aid device includes a signal processing part implantable
(Continued)

in a subject, the signal processing part processing a signal from a microphone to output an electrical signal, a vibration generation part configured for receiving the electrical signal to generate vibration, and a bellows member disposed at an end side of the vibration generation part to transmit the vibration to a round window of the subject. In some embodiments, the vibration generation part includes a magnet member or a piezoelectric vibration member to vibrate in accordance with the electrical signal.

9 Claims, 14 Drawing Sheets

(56) References Cited

U.S. PATENT DOCUMENTS

| | | | | |
|---|---|---|---|---|
| 6,068,589 | A | 5/2000 | Neukermans | |
| 7,753,838 | B2 | 7/2010 | Easter et al. | |
| 2005/0101830 | A1* | 5/2005 | Easter | H04R 25/606 600/25 |
| 2008/0293998 | A1* | 11/2008 | Andrews | H04R 25/606 600/25 |
| 2009/0023976 | A1* | 1/2009 | Cho | H04R 25/606 600/25 |
| 2009/0131742 | A1 | 5/2009 | Cho et al. | |
| 2009/0240099 | A1 | 9/2009 | Conn | |
| 2011/0105829 | A1* | 5/2011 | Ball | H04R 25/606 600/25 |
| 2013/0190552 | A1 | 7/2013 | Leblans | |
| 2014/0224283 | A1 | 8/2014 | Smith | |

FOREIGN PATENT DOCUMENTS

| | | | |
|---|---|---|---|
| KR | 20090051868 | A | 5/2009 |
| KR | 20120139026 | A | 12/2012 |

* cited by examiner

VIBRATION TRANSDUCER AND IMPLANTABLE HEARING AID DEVICE

CROSS-REFERENCE TO RELATED APPLICATIONS

This application is a divisional of U.S. patent application Ser. No. 14/644,658, filed on Mar. 11, 2015, which claims priority under 35 U.S.C. § 119 of Korean Patent Application No. 10-2014-0029755, filed on Mar. 13, 2014, the entire contents of which are hereby incorporated by reference.

BACKGROUND OF THE INVENTION

The present invention disclosed herein relates to a vibration transducer and an implantable hearing aid device.

Recently, hearing loss population in the whole world is continuously increasing due to industrialization and wide prevalence of sound systems having excellent performance. The hearing loss population may be largely classified into three major groups. The first one is a mild and moderate hearing loss group in which the hearing loss is solved with the aid of existing hearing aid devices. The second one is a moderately severe and severe hearing loss group in which the hearing loss is not easily solved with the aid of the existing hearing aid device. The third one is a profound hearing loss and congenital hearing impairment group in which the hearing loss or hearing impairment is solved only by using a cochlear implant. Here, a hearing loss solution for the moderately severe and severe hearing loss group accompanied by sensorineural hearing loss is relatively poor in comparison to other groups, and thus a lot of people having hearing loss are suffering.

Thus, various implantable hearing aid device models targeting the moderately severe and severe hearing loss group accompanying the sensorineural hearing loss are being studied throughout the world. Here, a middle ear implant is a hearing aid device in which auditory ossicles are forcibly vibrated to allow a wearer to hear a sound. The middle ear implant fields are most actively studied at the present, and a portion of the devices in the middle ear implant fields has been succeeded in commercialization. A model that is successfully settled in the present hearing aid device market is Vibrant Soundbridge developed by MED-EL company (Austria). The Vibrant Soundbridge uses a floating mass transducer (FMT) installed in the auditory ossicles as a transducer. Although various implantable hearing aid devices are being studied, there are still more requirements to be developed in performance so as to have a bigger share of the market in the world. Among those requirements, since a vibration transducer is a key factor that determines a characteristic of the implantable hearing aid device as an output unit of the middle ear implant, it may not be emphasized that the necessity of the vibration transducer having large vibration displacement and operating by low power.

Recently, it is being pointed out that when the FMT is installed into an incus, the incus is vulnerable to longterm safety. Clinically, these limitations are left unresolved. As an alternative, studies for a transducer directly applying vibration stimulus to a round window are widely underway in the academic world. When the transducer is driven in the round window, the transducer may not strain the auditory ossicles and be used in cases in which the auditory ossicles are destroyed due to chronic otitis media, or it is difficult to apply vibration to an oval window.

There are two types of round window driving vibration transducers. The existing FMT may be installed into the round window, and a MET transducer of Carina device that is being developed by Otologics company may be used to vibrate the round window. Additionally, there are Korean Patent Registration No. 10-0859979, which is entitled "Implantable Middle Ear Hearing Device with Tube Type Vibration Transducer" and has been suggested by Cho, Jin-ho and so on, Korean Patent Registration No. 10-0931209, which is entitled "Round Window Vibration Transducer with Easy Attachment Method and Implantable Hearing Aid Using the Transducer", and Korean Patent Registration No. 10-1223693, which is entitled "Round Window Driving Vibrator of Three-Coils Type with Excellent Driving Force".

However, when the vibration transducer is installed into the round window in the FMT method, vibration efficiency is poor at low frequency, because the FMT's amount of vibration is proportional to the mass acceleration of its magnet in the housing. Also, since the vibration transducer is affected by the external magnetic fields, the round window may be damaged in strong magnetic field environments such as MRI, or the transducer may get out of the round window. Also, since the MET transducer of Otologics company having a flat frequency characteristic in an audible range has a large scale, it may be difficult to secure a range of vision with respect to the round window during surgery. Thus, it is necessary to use a separate tip for contacting the round window. Also, the MET transducer may be affected by the external strong magnetic fields.

The round window drive-type tube vibration transducer disclosed in Korean Patent Registration No. 10-0859979 is driven by a manner using air or a fluid pressure generated in a tube. However, when an end of the tube has an opening, the opening is likely to be blocked by a body fluid exuding from an inner ear. Thus, the transducer may be deteriorated in performance when the transducer is continuously used. To solve the limitation, the end of the tube is treated as a diaphragm, and the round window vibrates by using the vibration of the diaphragm in Korean Patent Registration No. 10-0859979. However, since the diaphragm vibrates in a dome shape, a portion of area of the diaphragm contacts the round window. Thus, there is a limitation in that vibration energy is effectively transmitted into a cochlear. Therefore, to install a tube-type vibrator finished by using the diaphragm, there is a method in which a surgical drill is used to expand a niche portion of the round window, and a contact area between the vibrator and the round window is increased by using fascia tissue as a medium. When the diaphragm excessively increases in diameter to increase vibration transmission efficiency of the tube-type vibrator having the diaphragm, the transmission efficiency of the vibration energy may increase. However, the immoderate expansion of the niche of the round window may damage the cochlea, resulting from surgery. Also, since the vibration transducer using the diaphragm has to depend on only a thickness and diameter of the diaphragm to adjust the frequency characteristic, it may be difficult to precisely control the frequency characteristic.

SUMMARY OF THE INVENTION

The present invention provides a vibration transducer and an implantable hearing aid device that is capable of improving transmission efficiency of vibration applied into a cochlea.

The present invention also provides a vibration transducer and an implantable hearing aid device, that is capable of resolving limitations in which since there are various directions of round windows according to a subject to be implanted when the vibration transducer is implanted into the round window of a cochlea through a middle ear cavity, it is difficult to secure a range of vision because of auditory ossicles and a ligament, and also a vibrator itself is restricted in size and length.

The present invention also provides a vibration transducer and an implantable hearing aid device, that is capable of maintaining sealability and ensuring an excellent vibration displacement characteristic in spite of a small size thereof.

The present invention also provides a vibration transducer and an implantable hearing aid device, that is capable of maintaining excellent vibration characteristic with respect to sound signals in various frequency bands.

The present invention also provides a vibration transducer and an implantable hearing aid device that is capable of precisely being controlled in frequency characteristic.

The object of the present invention is not limited to the aforesaid. Other objects not described herein will be clearly understood by those skilled in the art from descriptions below.

Embodiments of the present invention provide implantable hearing aid devices including: a signal processing part implantable in a subject, the signal processing part processing a signal from a microphone to output a sound signal; a sound transmission tube configured for transmitting the sound signal to a round window of the subject; and a bellows member disposed at an end side of the sound transmission tube to transmit vibration due to the sound signal to the round window.

In some embodiments, the bellows member may be configured to form longitudinal wave vibration in a central axis direction of the sound transmission tube to apply the vibration to the round window.

In other embodiments, the implantable hearing aid devices may further include a vibration transmission member disposed at an end side of the bellows member, the vibration transmission member having a curved surface shape.

In still other embodiments, the bellows member may be formed of a biocompatible metal material or a silicone material.

In even other embodiments, the bellows member may include: a plurality of crests; and a plurality of troughs, each trough being disposed between neighboring crests.

In yet other embodiments, the bellows member may include a first and a second bellows parts, each bellows part including the crests and troughs, a pitch of the first bellows part being different from a pitch of the second bellows part.

In further embodiments, the bellows member may include a first and a second bellows parts, each bellows part including the crests and troughs, a size of the crest of the first bellows part being different from a size of the crest of the second bellows part and/or a size of the trough of the first bellows part being different from a size of the trough of the second bellows part.

In other embodiments of the present invention, implantable hearing aid devices include: a signal processing part implantable in a subject, the signal processing part processing a signal from a microphone to output an electrical signal; a vibration generation part receiving the electrical signal to generate vibration; and a bellows member disposed at an end side of the vibration generation part to transmit the vibration to a round window of the subject.

In some embodiments, the vibration generation part may include: a case; a coil part disposed in the case to generate magnetic fields by the electrical signal; and a magnet member disposed in the case to vibrate in accordance with the magnetic fields.

In other embodiments, the vibration generation part may further include an elastic member that is disposed on an inner surface to elastically support the magnet member.

In still other embodiments, the vibration generation part may further include connection member connecting the magnet member to the bellows member so that the vibration of the magnet member is transmitted to the bellows member.

In even other embodiments, the vibration generation part may include: a case; and a piezoelectric vibration member disposed in the case to generate vibration in accordance with the electrical signal.

In yet other embodiments, the vibration generation part may further include a connection member connecting the piezoelectric vibration member to the bellows member so that the vibration of the piezoelectric vibration member is transmitted to the bellows member.

In further embodiments, a lead hole through which a lead wire for transmitting the electrical signal passes may be defined in a side surface of the case, and a cover may be coupled to a lower portion of the case to finish the lead hole and have a lead groove in an inner surface thereof to allow the lead wire to be inserted into the lead groove.

In still other embodiments of the present invention, vibration transducers include: a sound transmission tube implantable in a subject, the sound transmission tube having a passage through which the sound signal is transmitted from one end to the other end thereof; and a bellows member disposed at an end side of the sound transmission tube, the bellows member being configured for applying longitudinal wave vibration to auditory tissue of the subject according to the sound signal.

In even other embodiments of the present invention, vibration transducers include: a vibration generation part implantable in a subject, the vibration generation part receiving an electrical signal to generate vibration; and a bellows member disposed at an end side of the vibration generation part, the bellows member being configured for applying longitudinal wave vibration to auditory tissue of the subject according to the sound signal.

In some embodiments, the vibration transducers may further include a vibration transmission member disposed at an end side of the bellows member, the vibration transmission member having a curved surface shape.

In other embodiments, the bellows member may include a first and a second bellows parts, each bellows part including the crests and troughs, a pitch of the first bellows part being different from a pitch of the second bellows part.

BRIEF DESCRIPTION OF THE DRAWINGS

The accompanying drawings are included to provide a further understanding of the present invention, and are incorporated in and constitute a part of this specification. The drawings illustrate exemplary embodiments of the present invention and, together with the description, serve to explain principles of the present invention. In the drawings.

DETAILED DESCRIPTION OF PREFERRED EMBODIMENTS

Figure 1:
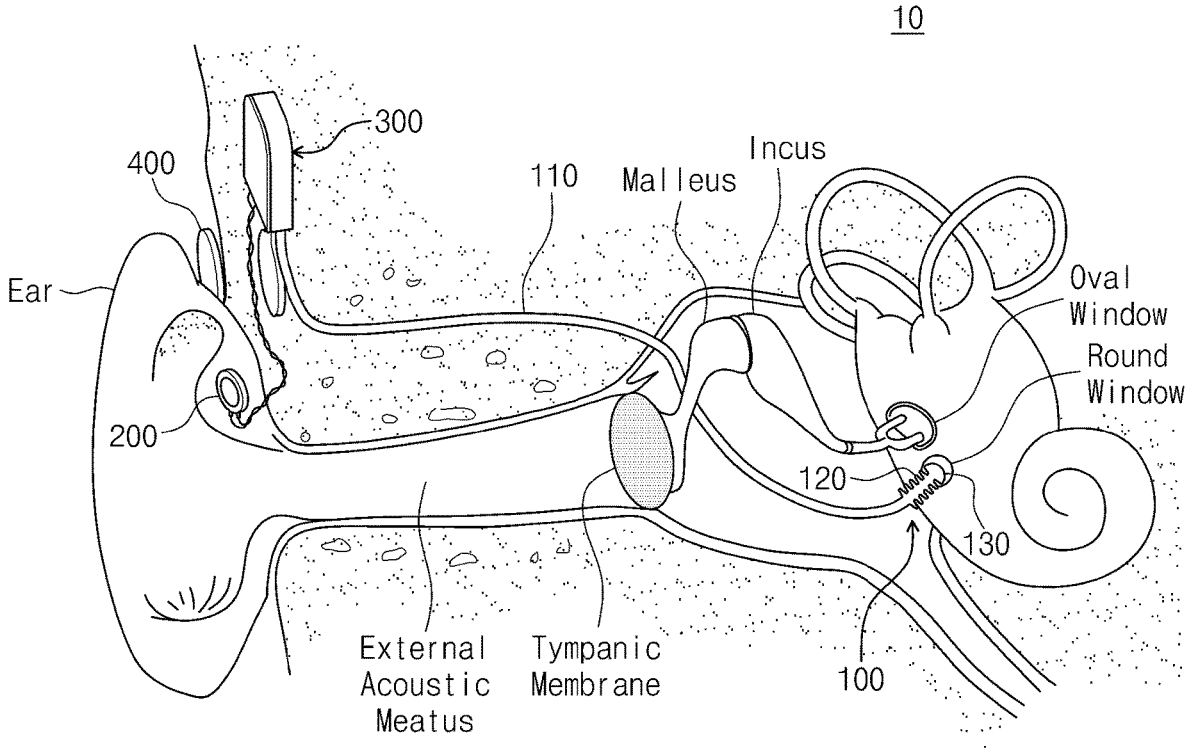
FIG. 1 is a view illustrating a state in which an implantable hearing aid device is implanted into a body according to an embodiment of the present invention.

Advantages and features of the present invention, and implementation methods thereof will be clarified through following embodiments described with reference to the accompanying drawings. However, the present invention should not be construed as being limited to the embodiments set forth herein and is only defined by scopes of claims. Unless otherwise defined, all terms (including technical and scientific terms) used herein have the same meaning as generally understood by those skilled in the art. Detailed descriptions related to well-known functions or configurations will be ruled out in order not to unnecessarily obscure subject matters of the present invention. In the drawings, like reference numerals refer to like elements throughout.

A vibration transducer according to an embodiment of the present invention may ensure an excellent vibration displacement characteristic by a bellows-type wrinkle member (hereinafter, referred to as a bellows member) formed on an end thereof. Also, the vibration transducer may transmit vibration generated by the bellows member to auditory tissue of a body such as a round window at high transmission efficiency. FIG. 1 is a view illustrating a state in which an implantable hearing aid device is implanted into a body according to an embodiment of the present invention. Referring to FIG. 1, an implantable hearing aid device 10 according to an embodiment of the present invention includes a signal processing part 300 and a vibration transducer 100. The signal processing part 300 may be implant into a subject to be implanted (hereinafter, referred to as an "implant body"), i.e., a human body. The signal processing part 300 may process a signal transmitted from a microphone 200 to output a sound signal. For example, the signal processing part 300 may be subcutaneously installed into a temporal bone of a human body. The signal processing part 300 may receive power or a control signal required to operate from an external device 400 disposed on an outer side of human skin.

Although the microphone 200 is disposed on an ear portion of the human body in the embodiment illustrated in FIG. 1, the microphone 200 is not limited to its installation position. For example, the microphone 200 may be implanted into a tympanic membrane or an inner wall of a middle ear cavity of the human body or be disposed at a side of the signal processing part 300 or external device 400. The microphone 200 may detect an external sound to transmit an electrical signal having a frequency and amplitude corresponding to the external sound to the signal processing part 300.

The signal processing part 300 may perform signal processing such as amplification of the signal transmitted from the microphone 200 and output the sound signal or the electrical signal to the vibration transducer 100. The vibration transducer 100 may covert the sound or electrical signal received from the signal processing part 300 into vibration to apply the vibration to the auditory tissue that is in contact with the end thereof, thereby transmitting the vibrations into the cochlea. In the embodiment illustrated in FIG. 1, the vibration transducer 100 may apply vibration corresponding to the external sound to the round window so that a user implanted with the implantable hearing aid device 10 recognizes the external sound. Alternatively, the vibration transducer 100 may apply vibration to other auditory tissue of the body except for the round window, e.g., to auditory ossicles and an oval window.

The vibration transducer 100 may be implanted so that the end of the vibration transducer 100 is inserted into an entrance of the round window. In an embodiment of the present invention, the vibration transducer 100 includes a sound transmission tube 110, a bellows member 120, and a vibration transmission member 130. Detailed structure, function, and operation of the vibration transducer 100 will be described later. Since the round window driving-type implantable hearing aid device 10 according to an embodiment of the present invention directly transmits sound vibration to the round window without passing through the tympanic membrane and auditory ossicles of the human body, the hearing aid device 10 may transmit the sound at high efficiency and easily compensate the hearing loss.

Figure 2:
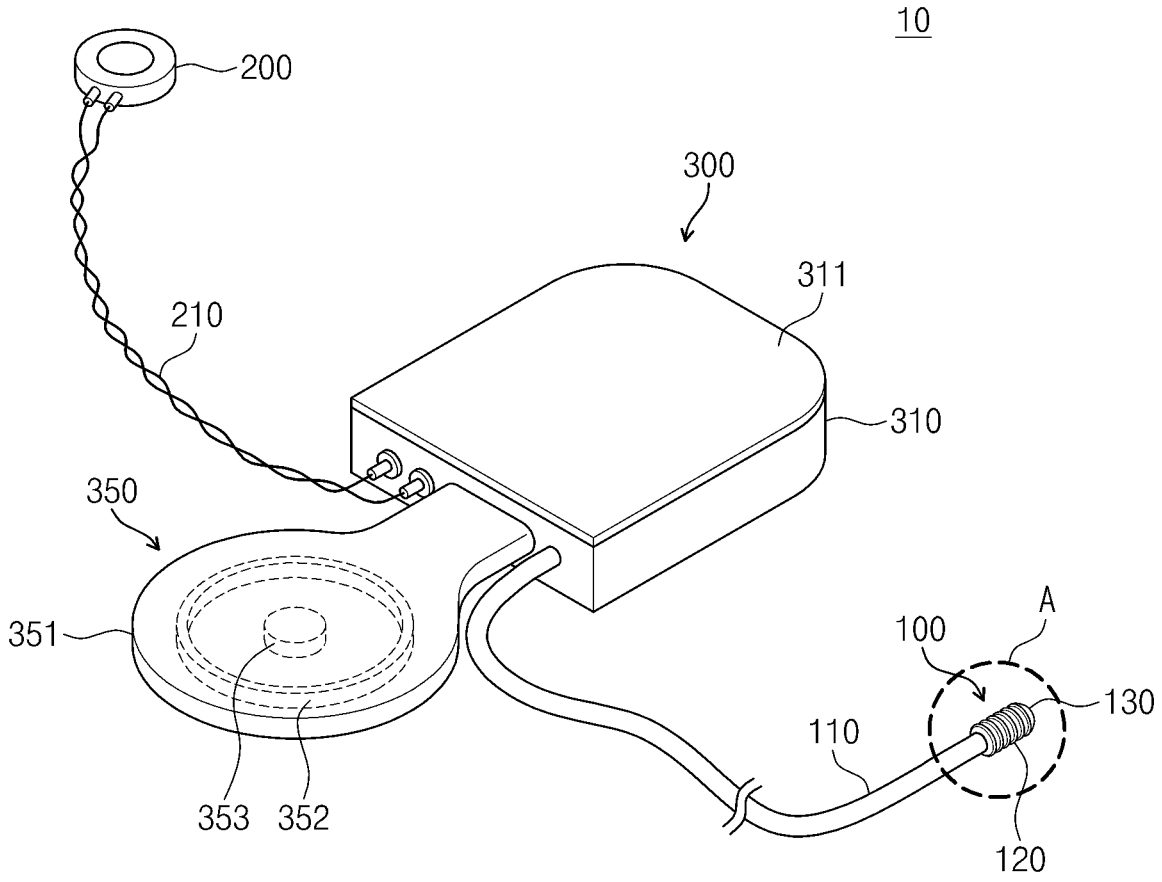
FIG. 2 is a perspective view of an implantable hearing aid device according to an embodiment of the present invention.
Figure 3:
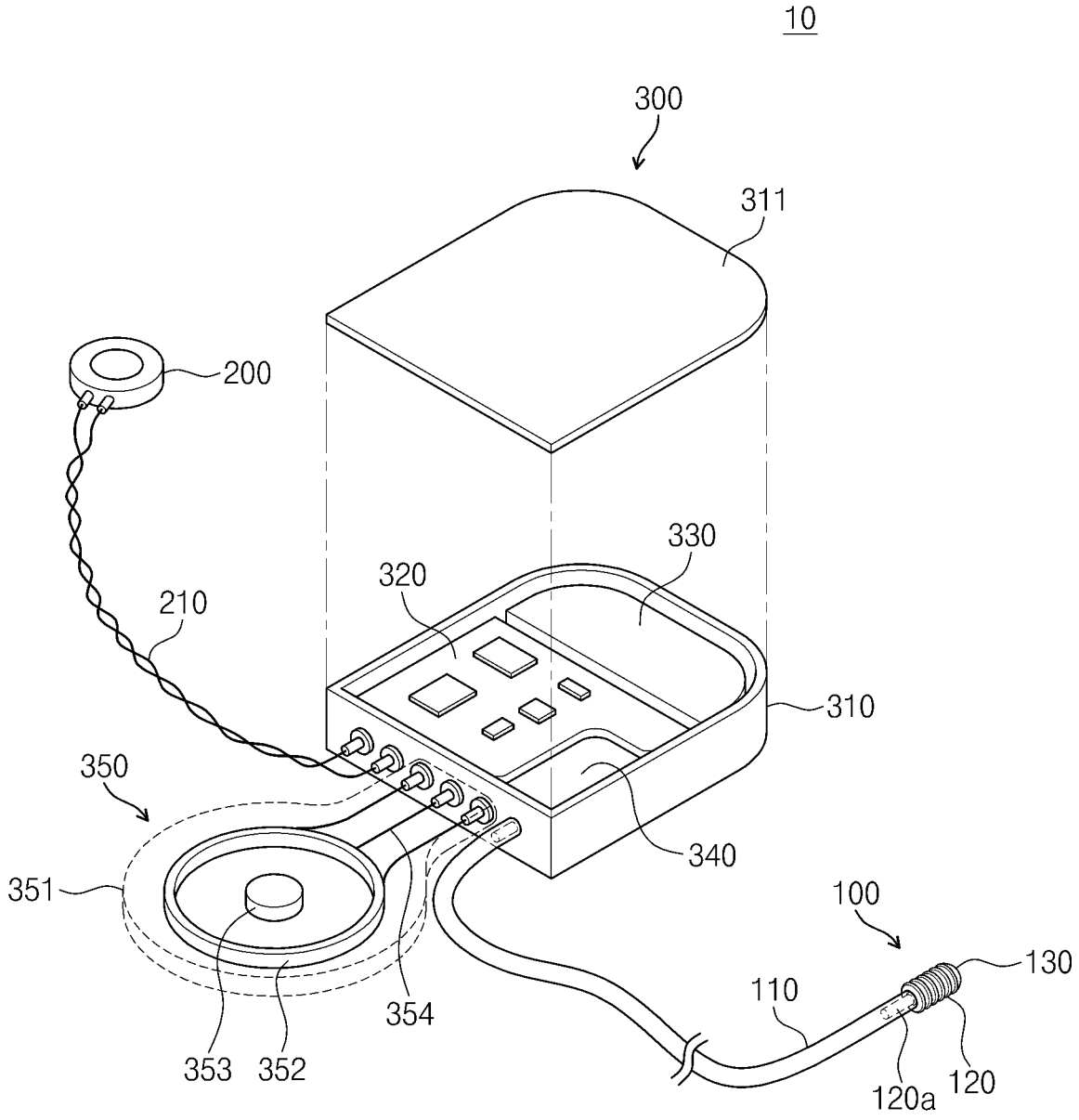
FIG. 3 is an exploded perspective view of the implantable hearing aid device according to an embodiment of the present invention.

FIG. 2 is a perspective view of an implantable hearing aid device according to an embodiment of the present invention, and FIG. 3 is an exploded perspective view of the implantable hearing aid device according to an embodiment of the present invention. FIG. 3 is a view illustrating a state in which a cover 311 of a housing 310 constituting a signal processing part 300 is opened. Referring to FIGS. 1 to 3, the signal processing part 300 includes a housing 310, a signal processing circuit 320, a battery 330, a sound generation unit 340, and a wireless communication unit 350. The signal processing circuit 320, the battery 230, and the sound generation unit 340 may be built in the housing 310.

The signal processing circuit 320 may perform signal processing, e.g., amplify the signal transmitted from the microphone 200 through a wire 210 and remove noises from the signal. The battery 330 may supply a power source to operate the signal processing part 300. The battery 330 may receive power from a device 400 that is disposed outside the human body (hereinafter, referred to as an "external device") through the wireless communication unit 350 and thus be charged. The sound generation unit 340 may generate a sound signal from the signal processed by the signal processing circuit 320 to output the sound signal to the sound transmission tube 110 of the vibration transducer 100.

The wireless communication unit 350 includes a coil member 352, a magnet member 353, and a wire member 354. The coil member 352, the magnet member 353, and the wire member 354 may be disposed in a casing 351. The coil member 352 may receive power or a control signal from a coil of the external device 400 by electromagnetic induction. The magnet member 353 is disposed to fix a relative position between the external device 400 and the signal processing unit 300 by a magnetic force between magnets of the external device 400. The wire member 354 may supply the power supplied through the coil member 352 to the battery 330 and transmit a control signal to the signal processing circuit 320.

Figure 4A:
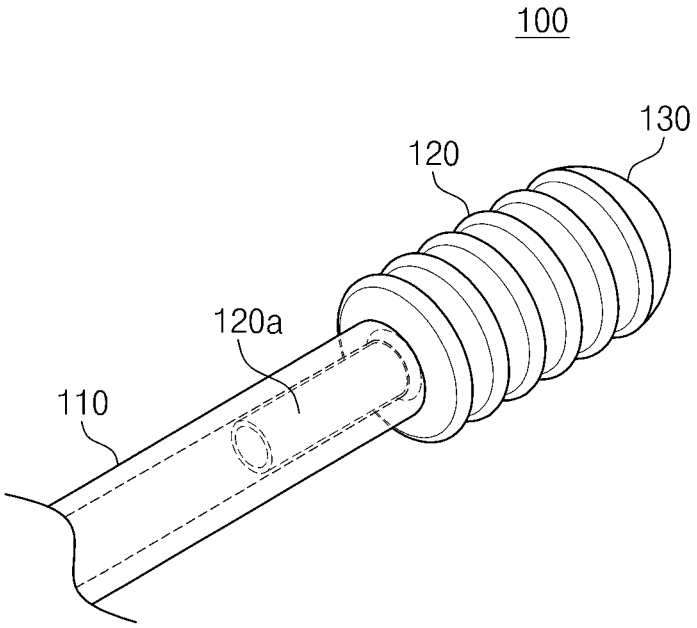
FIG. 4A is an enlarged perspective view of portion 'A' of FIG. 2.
Figure 4B:
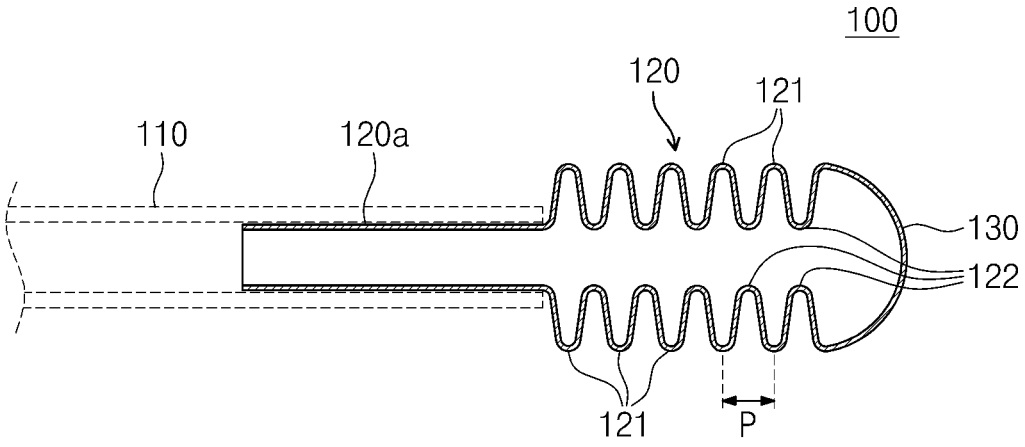
FIG. 4B is a cross-sectional view of a vibration transducer of FIG. 4A.

FIG. 4A is an enlarged perspective view of portion 'A' of FIG. 2, and FIG. 4B is a cross-sectional view of a vibration transducer of FIG. 4A. Referring to FIGS. 4A to 4B, the vibration transducer 100 includes the sound transmission tube 110, the bellows member 120, and the vibration transmission member 130. The sound transmission tube 110 provides a sound passage through which the sound signal is transmitted to the round window. The sound transmission tube 110 may be formed of a biocompatible material having flexibility. For example, the sound transmission tube 110 may be formed of a silicone, polymer or metal material.

The bellows member 120 is disposed at an end side of the sound transmission tube 110 toward the round window. The bellow member 120 may form longitudinal wave vibration from the sound signal transmitted through the sound transmission tube 110 in a central axis direction of the sound transmission tube 110 to apply the vibration according to the sound signal to the round window. The vibration transducer 100 may vibrate by elasticity due to a crest and trough of the bellows member 120. The bellows member 120 may be formed of a biocompatible material. For example, the bellows member 120 may be formed of a silicone, polymer or metal material. In one embodiment, the bellows member 120 may have a coupling protrusion 120*a* at an end side thereof toward the sound transmission tube 110. The coupling protrusion 120*a* may have an outer diameter that is equal to or slightly greater than an inner diameter of the sound transmission tube 110. Thus, the coupling protrusion 120*a* may be tightly fitted and coupled to the end of the sound transmission tube 110. Alternatively, the coupling protrusion 120 may have a screw part on an outer circumferential surface thereof and thus be screw-coupled to the end of the sound transmission tube 110. In another example, the bellows member 120 and the sound transmission tube 110 may be integrally manufactured.

The bellows member 120 includes a plurality of crests 121 and troughs 122 defined between the crests 121 adjacent to each other. A distance between the crests 121 adjacent to each other constituting the bellows member 120, i.e., a pitch P and a size of each of the crest 121 and the trough 122 may be designed so that vibration is efficiently applied to the round window according to a sound signal having an audible frequency band of about 20 Hz to about 20,000 Hz. The frequency characteristic of the vibration transducer may be precisely controlled by designing a shape of the bellows member.

In the embodiment illustrated in FIGS. 4A to 4B, the crest 121 may have a size greater than that of the sound transmission tube 110, and the trough 122 may have a size corresponding to that of the sound transmission tube 110. That is, in the bellows member 120, the crest 121 protrudes outward from an outer surface of the sound transmission tube 110. The vibration transmission member 130 may be disposed at the end side of the bellows member 120 toward the round window. The vibration transmission member 130 may have a curved outer surface shape so that the transducer 100 easily contacts the round window, and an area of the round window to which the vibration is applied increases. The vibration transmission member 130 may be formed of a biocompatible material, e.g., a silicone, polymer or metal material. In the embodiment illustrated in FIGS. 4A to 4B, although the vibration transmission member 130 and the bellows member 120 are integrally formed, the present invention is not limited thereto. For example, a member having a convex dome shape in an axial direction of the bellows member may be attached to the end side of the bellows member 120.

Figure 4C:
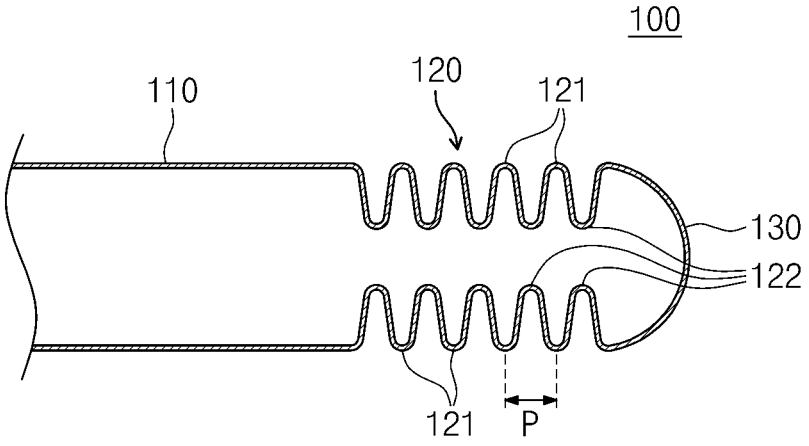
FIG. 4C is a cross-sectional view of a vibration transducer according to another embodiment of the present invention.

FIG. 4C is a cross-sectional view of a vibration transducer according to another embodiment of the present invention. The embodiment illustrated in FIG. 4C is different from that illustrated in FIGS. 4A to 4B in that the crest 121 has a size corresponding to that of the sound transmission tube 110, the trough 122 has a size less than the inner diameter of the sound transmission tube 110, that is, the trough 122 protrudes inward from an inner surface of the sound transmission tube 110, and the sound transmission tube 110 and the bellows member 120 are integrally provided. According to the embodiment illustrated in FIG. 4C, since the bellows member 120 constituting the vibration transducer 100 is maintained in the same size as the diameter of the sound transmission tube 110, the vibration transducer 100 may be minimized enough to directly contact the round window and thus easily secure a range of vision when a surgery for implanting the vibration transducer 100 is performed. That is, the embodiments of the present invention may resolve the limitations in which since there are various directions of round windows according to subjects to be implanted when the vibration transducer is implanted into the round window of a cochlea through a middle ear cavity, it is difficult to secure a range of vision because of auditory ossicles and a ligament, and also a vibrator itself is restricted in size and length.

Figure 5A:
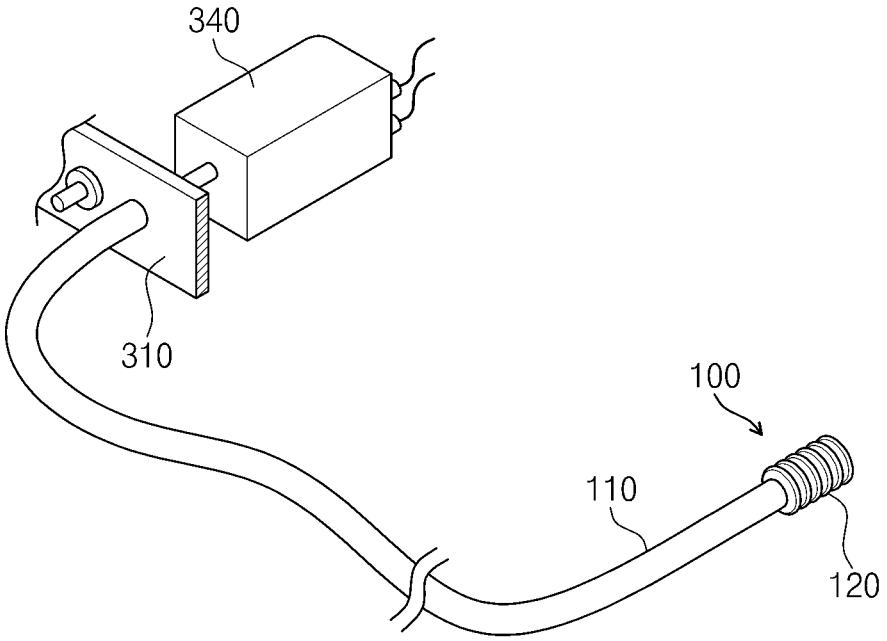
FIG. 5A is a partial perspective view of an implantable hearing aid device according to another embodiment of the present invention.
Figure 5B:
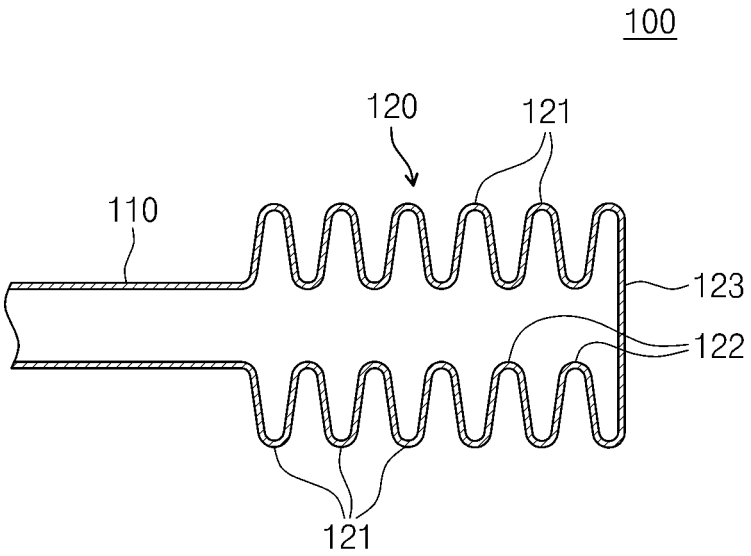
FIG. 5B is a cross-sectional view of a vibration transducer of FIG. 5A.

FIG. 5A is a partial perspective view of an implantable hearing aid device according to another embodiment of the present invention, and FIG. 5B is a cross-sectional view of a vibration transducer of FIG. 5A. The embodiment illustrated in FIGS. 5A to 5B is different from that illustrated in FIGS. 4A to 4B in that a flat surface member 123 is disposed at the end side of the bellows member 120 instead of the vibration transmission member 130 having a dome shape. According to the embodiment illustrated in FIGS. 5A to 5B, the flat surface member 120 disposed at the end side of the bellows member 120 may be directly in contact with the round window to transmit the vibration.

Figure 6:
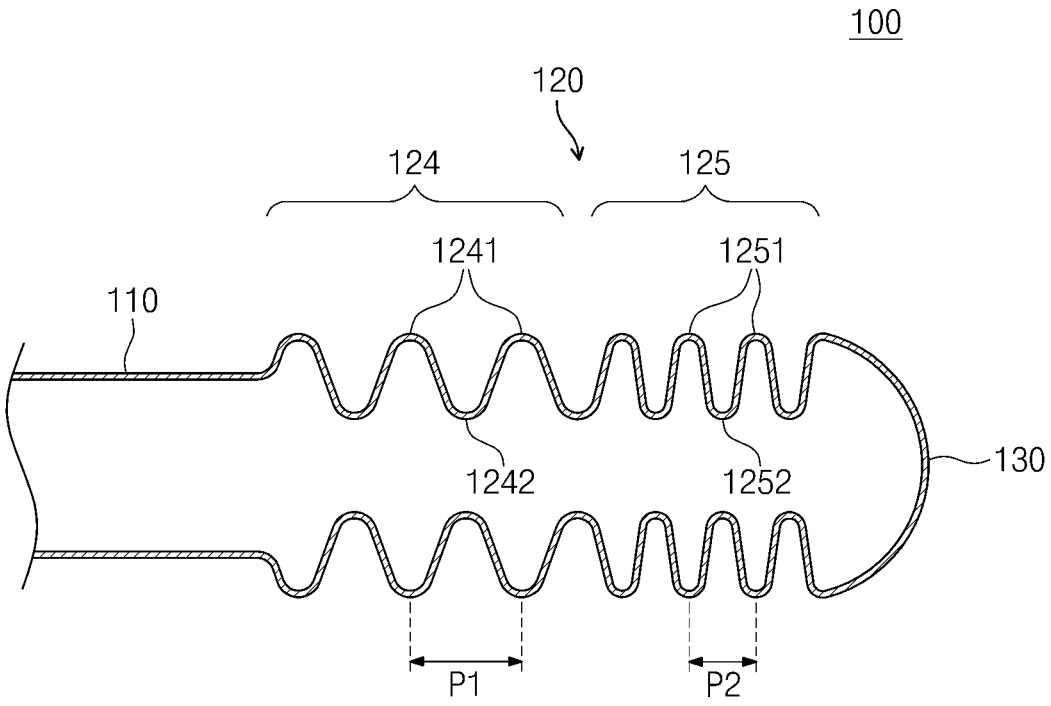
FIG. 6 is a cross-sectional view of a vibration transducer according to further another embodiment of the present invention.

FIG. 6 is a cross-sectional view of a vibration transducer according to further another embodiment of the present invention. Referring to FIG. 6, the embodiment is different from that illustrated in FIGS. 4A to 4B in that the bellows member 120 includes a plurality of bellows parts 124 and 125 including crests and troughs having pitches different from each other. In the embodiment illustrated in FIG. 6, the bellows member 120 includes two bellows parts 124 and 125, that is, a first bellows part 124 including crests 1241 and trough 1242 of a first pitch P1 and a second bellows part 125 including crests 1251 and trough 1252 of a second pitch P2. Alternatively, the bellow member 120 may include three or more bellows parts including crests and troughs having different from each other.

Since the first bellows part 124 has the first pitch P1 of the crests 1241 and trough 1242 greater than those of the second bellows part 125, the first bellows part 124 may relatively efficiently convert a sound signal having a relatively lower frequency into vibration, in comparison to the second bellows part 125, to apply the vibration to the round window. Since the second bellows part 125 has the second pitch P1 of the crests 1251 and trough 1252 less than those of the first bellows part 124, the second bellows part 125 may relatively efficiently convert a sound signal having a relatively higher frequency into vibration, in comparison to the first bellows part 124, to apply the vibration to the round window. Thus, in the vibration transducer 100 illustrated in FIG. 6, since the first bellows part 124 applies vibration to the round window at the sound signal having the relatively lower frequency by the vibration thereof, and the second bellows part 125 applies vibration to the round window at the sound signal having the relatively higher frequency by the vibration thereof, the vibration transducer 100 may apply highly efficient vibration to the round window according to the sound signals having various frequency bands by using the plurality of bellows parts having pitches different from each other.

Figure 7A:
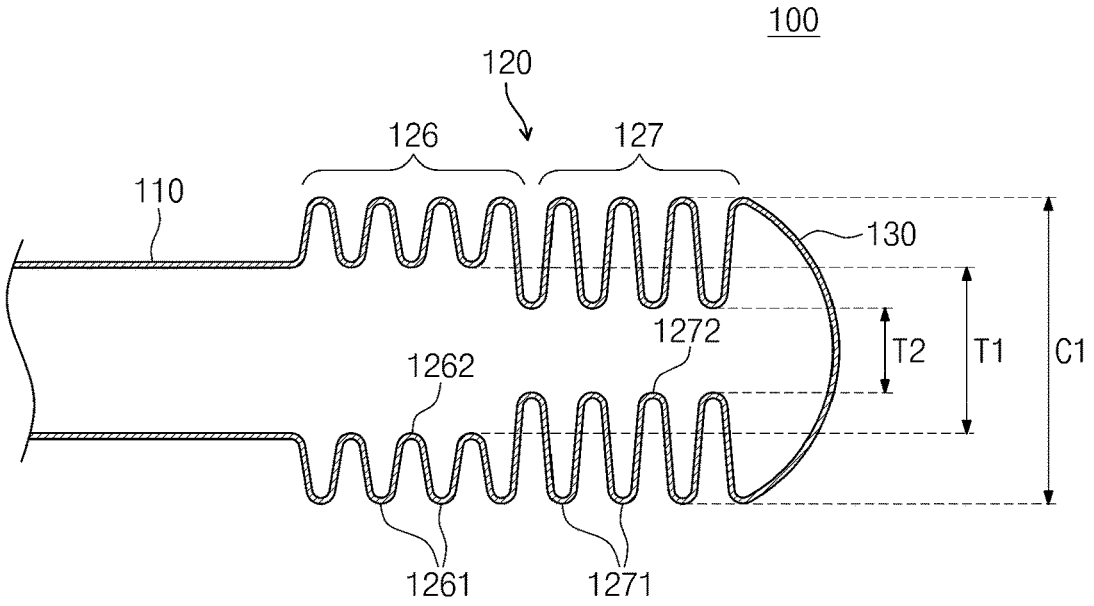
FIGS. 7A to 7B are cross-sectional views of vibration transducers according to various embodiments of the present invention.
Figure 7B:
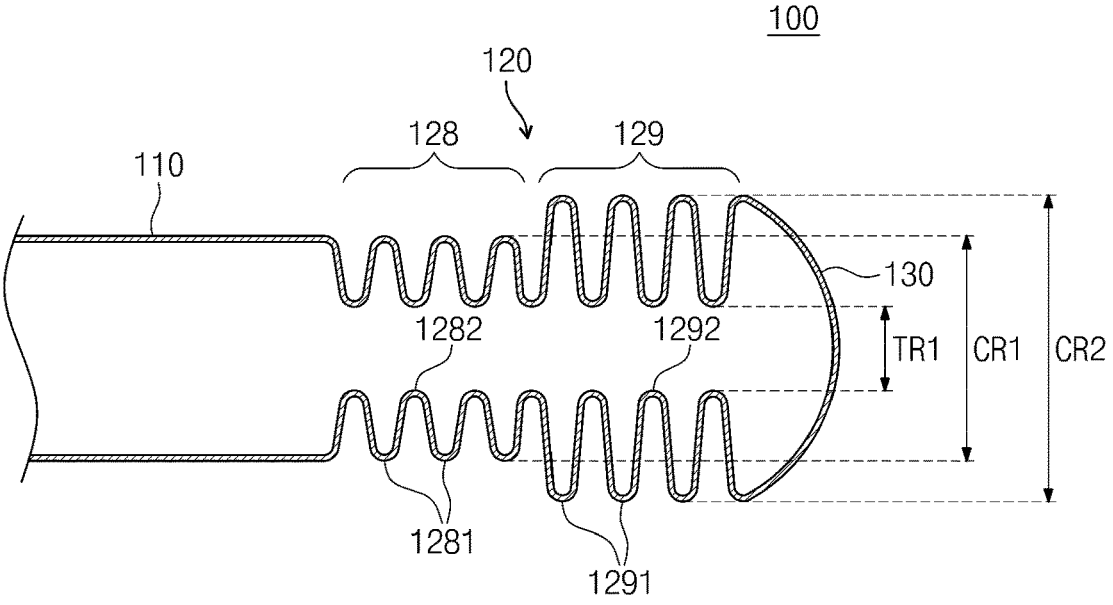

FIGS. 7A to 7B are cross-sectional views of vibration transducers according to various embodiments of the present invention. The embodiments illustrated in FIGS. 7A to 7B are different from that illustrated in FIGS. 4A to 4B in that a plurality of bellows parts 126 and 127 including troughs having sizes different from each other and a plurality of bellows parts 128 and 129 including crests having sizes different from each other are provided. Although the bellows member 120 includes two bellows parts in the embodiments illustrated in FIGS. 7A to 7B, the bellows member 120 may include three or more bellows parts including crests and troughs having pitches different from each other.

In the embodiment illustrated in FIG. 7A, a second bellows part 127 includes a crest 1271 having the same size Cl as that of a crest 1261 of a first bellows part 126 and a trough 1272 having a size T2 less than that T1 of a trough 1262 of the first bellows part 126. In the embodiment illustrated in FIG. 7B, a second bellows part 129 includes a trough 1292 having the same size CR1 as that of a trough 1282 of a first bellows part 128 and a crest 1291 having a size CR2 greater than that CR1 of a crest 1281 of the first bellows part 128. Thus, since first and the second bellow parts 126 and 127 have ratios of crests to troughs, which are different from each other, the first and second bellows parts 126 and 127 may have frequency bands, which represent the maximum vibration conversion efficiency, different from each other. Thus, according to the embodiments of FIGS. 7A to 7B, the plurality of bellows parts having ratios of crests to troughs different from each other may be used to apply high efficiency vibration with respect to sound signals having various frequency bands to the round window.

Figure 8:
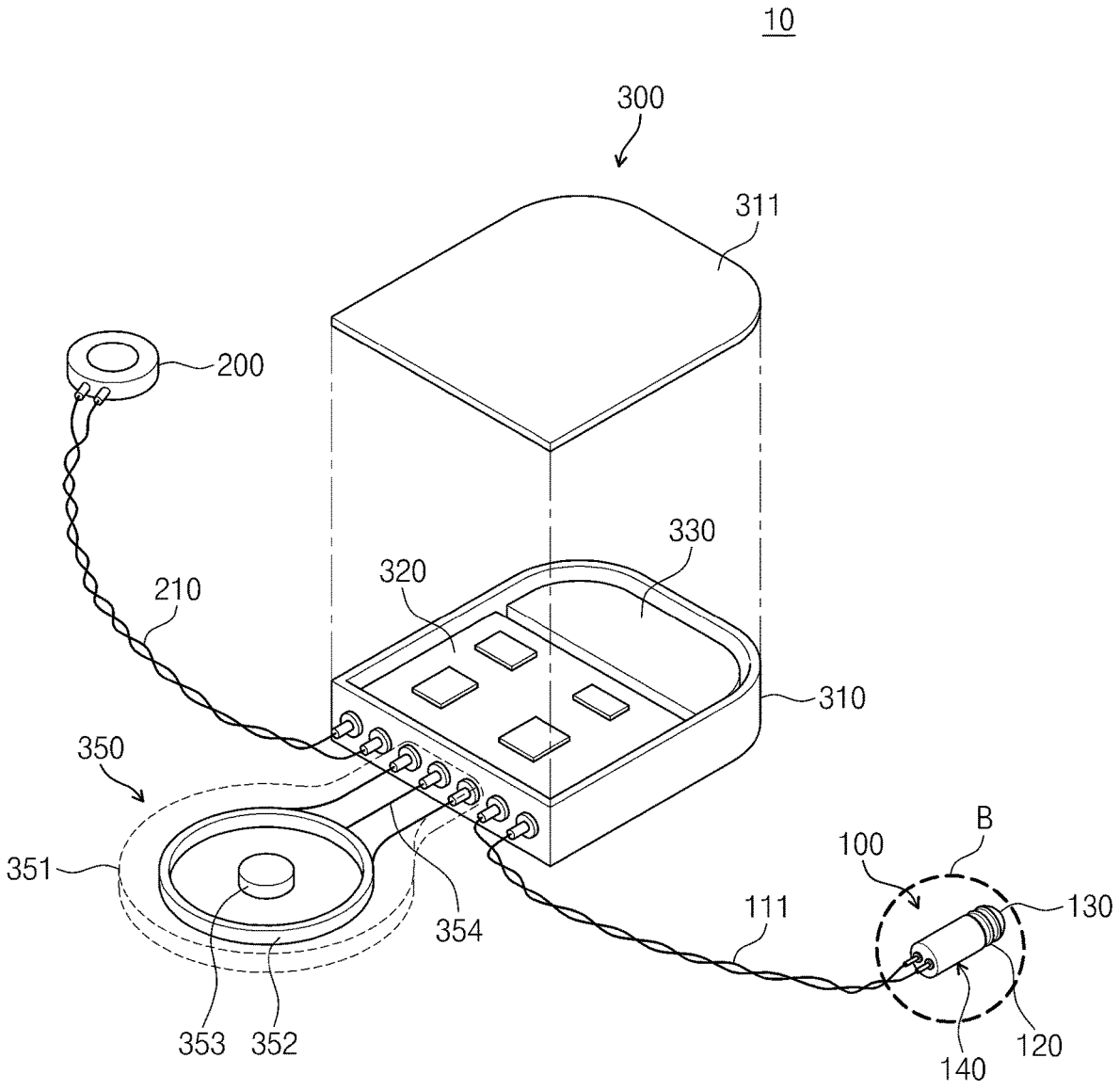
FIG. 8 is an exploded perspective view of an implantable hearing aid device according to further another embodiment of the present invention.
Figure 9:
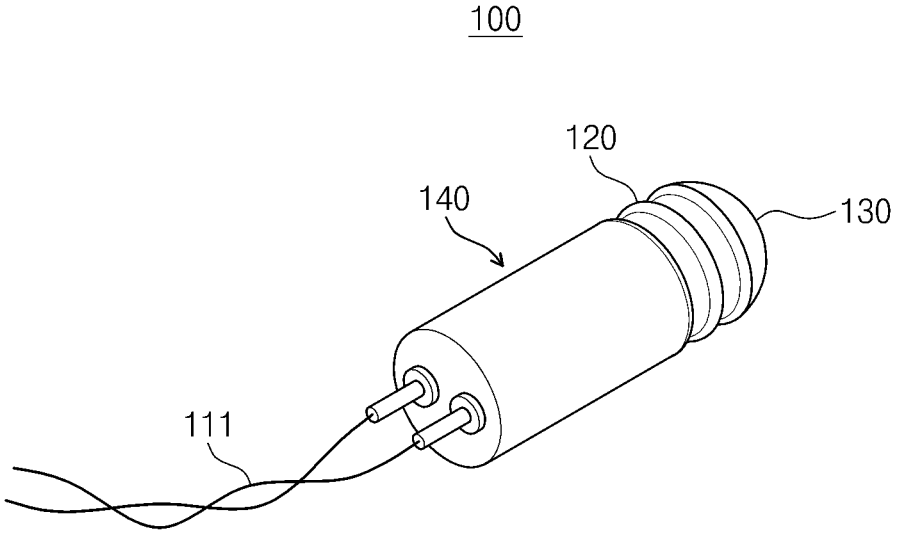
FIG. 9 is an enlarged perspective view of portion 'B' of FIG. 8.

FIG. 8 is an exploded perspective view of an implantable hearing aid device according to further another embodiment of the present invention, and FIG. 9 is an enlarged perspective view of portion 'B' of FIG. 8. An embodiment illustrated in FIGS. 8 to 9 is different from that illustrated in FIGS. 1 to 3 in that the signal processing part 300 processes a signal received from the microphone 200 to output an electrical signal instead of the sound signal, the vibration transducer 100 further includes a wire member 111 for transmitting the electrical signal outputted form the signal processing part 300 and a vibration generation part 140 receiving the electrical signal through the wire member 111 to generate vibration corresponding to the electrical signal, and the bellows member 120 is disposed at the end side of the vibration generation part 140. In the embodiment illustrated in FIG. 8, the vibration transducer 100 may further include a tube member (not shown) surrounding the wire member 111.

Figure 10A:
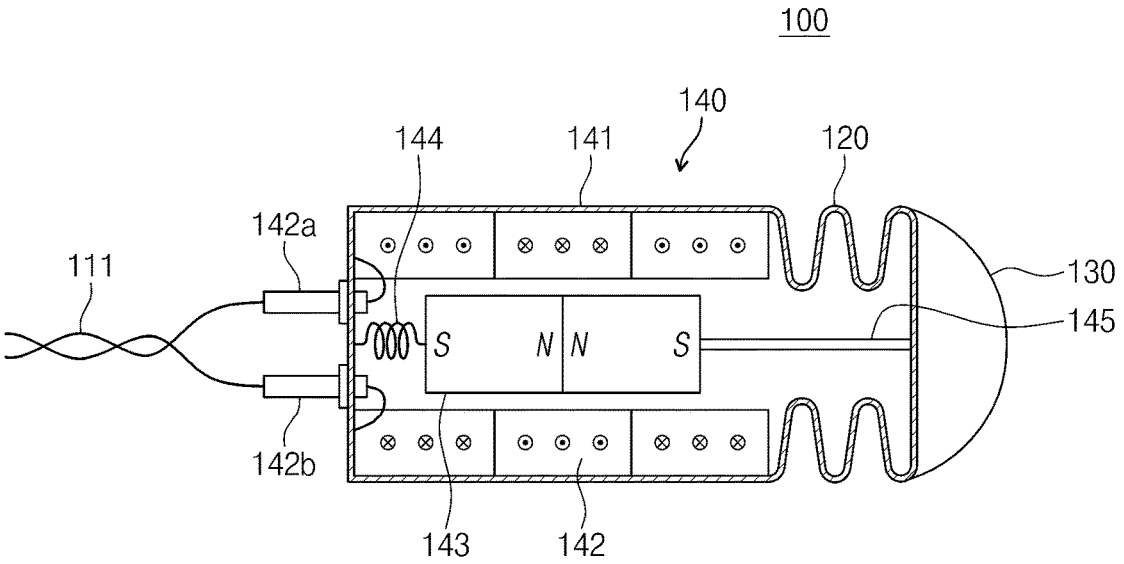
FIG. 10A is an enlarged cross-sectional view of portion 'B' of FIG. 8.
Figure 10B:
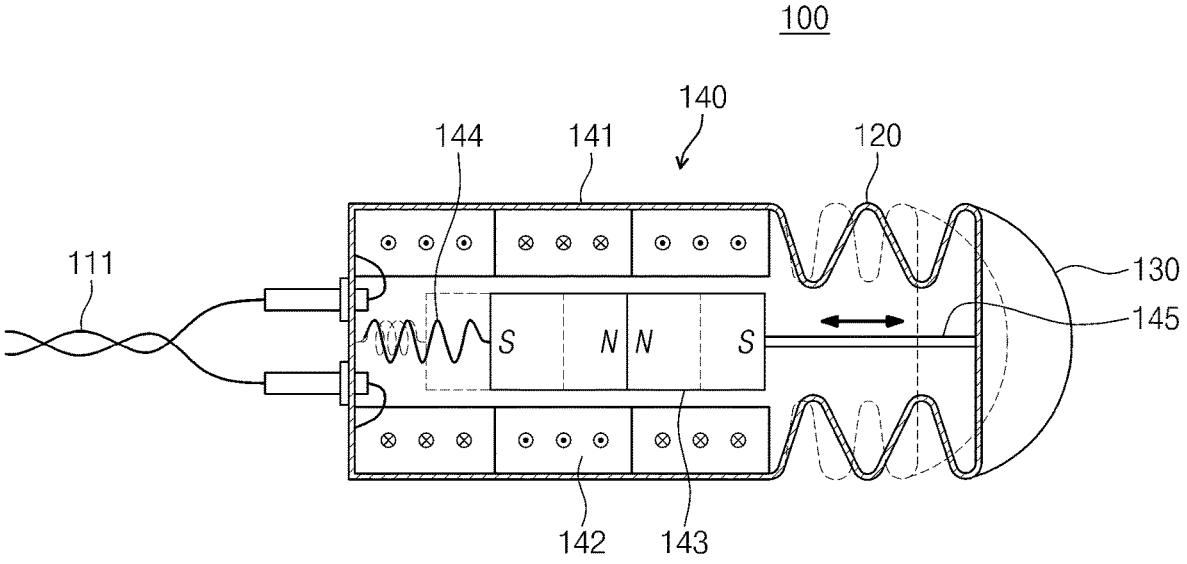
FIG. 10B is a view illustrating an operation of the vibration transducer constituting the implantable hearing aid device of FIG. 8.

FIG. 10A is an enlarged cross-sectional view of portion 'B' of FIG. 8, and FIG. 10B is a view illustrating an operation of the vibration transducer constituting the implantable hearing aid device of FIG. 8. Referring to FIGS. 8 to 10B, the vibration generation part 140 includes a case 141 having a cylindrical shape, electrodes 142*a* and 142*b* disposed on the case 141, a coil part 142, a magnet member 143, an elastic member 144, and a connection member 145. The electrodes 142*a* and 142*b* may be disposed at an end side of the case 141 toward the wire member 111 to receive an electric signal transmitted through the wire member 111, thereby inputting the electrical signal into the coil part 142. The coil part 142 may have a cylindrical shape and be disposed on an inner surface of the case 141. The coil part 142 may generate magnetic fields according to the electrical signal inputted through the electrodes 142*a* and 142*b*. Alternatively, the coil part 142 may be disposed on an outer surface of the case 141 unlike the embodiment illustrated in FIGS. 10A to 10B.

The magnet member 143 may be disposed on a central axis of the cylindrical case 141 and vibrate in a central axis direction by the magnetic fields formed by the coil part 142. The elastic member 144 may be disposed at a side of the inner surface of the case 141 to elastically support the magnet member 143. The connection member 145 may connect the magnet member 143 to the bellows member 120 so that the vibration of the magnet member 143 is transmitted to the bellows member 120. The magnet member 143 may be provided in a shape in which two permanent magnets are forcibly coupled to each other so that sides of the magnets having the same polarity face each other so as to not be affected by external magnetic fields.

The coil part 142 may have a structure in which coils change in winding direction in three stages to generate strong vibration in two magnets. Thus, the magnet member 143 may vibrate as illustrated in FIG. 10B by magnetic fields formed by the two magnets constituting the magnet member 143 and force generated from magnetic fields induced by the coil part 142. Since the magnet member 143 has the structure in which two magnets are coupled to each other to have magnetic moments opposite to each other, when a magnetic resonance imaging (MRI) scan is performed with respect to a patient implanted with the implantable hearing aid device 10, the transducer 100 may reduce a pain resulting from MRI magnetic fields applied to the magnet member 143. Also, artifacts in MRI image may be reduced to improve quality of the MRI image. Here, the vibration of the magnet member 143 may be stably efficiently transmitted to the round window by the bellows member 120.

Although not shown, the coil part 142 may be disposed on the central axis of the case 141, and a hollow cylindrical magnet member 143 may be disposed outside the coil part 142, and thus any one of the magnet member 143 and the coil part 142 may vibrate. For example, the magnet member 143 may be fixed to an entrance side of the round window, and at the same time, the coil part 142 may vibrate instead of the magnet member 143. Then, the coil part 142 may be connected to the bellows member 120 by the connection member to transmit the vibration thereof to the bellows member 120.

Figure 11A:
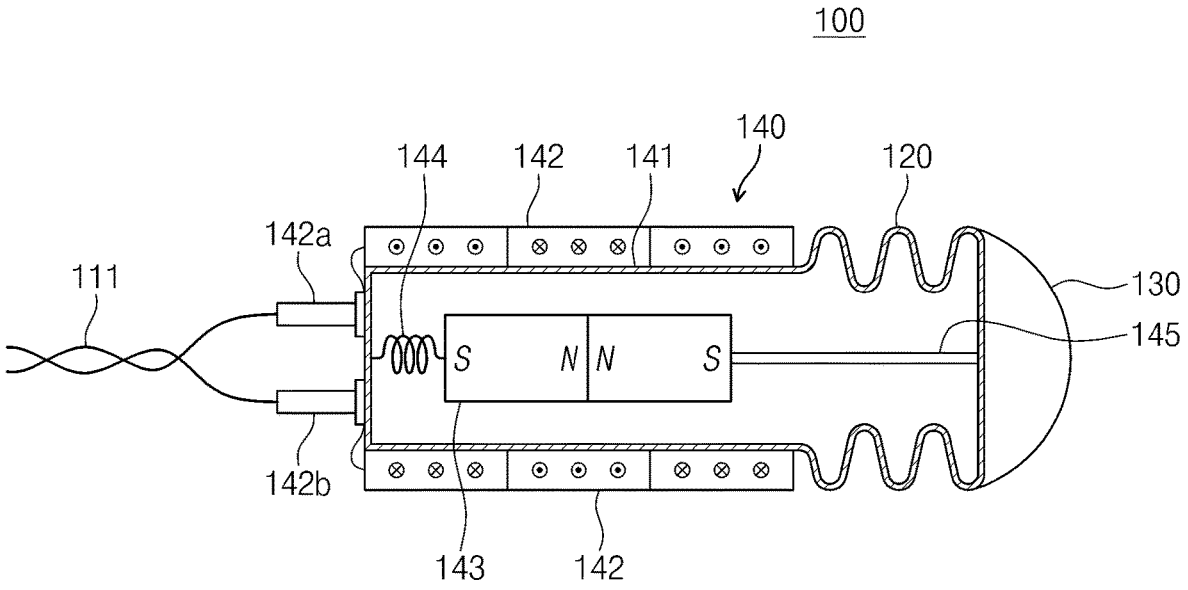
FIG. 11A is a cross-sectional view of a vibration transducer according to further another embodiment of the present invention.

FIG. 11A is a cross-sectional view of a vibration transducer according to further another embodiment of the present invention. The vibration transducer 100 illustrated in FIG. 11A is different from that in the embodiment illustrated in FIG. 10A in that the coil part 142 is disposed on the outer surface of the case 141 instead of the inner surface of the case 141. That is, a coil may be wound around the outer surface of the case 141 to form the coil part 142. The case 141 may be formed of a nonmagnetic material. The magnet member 143 may vibrate by an alternating current (AC) flowing through the coil part 142. According to the embodiment of FIG. 11A, the coil part 142 may be easily installed to the case 141.

Figure 11B:
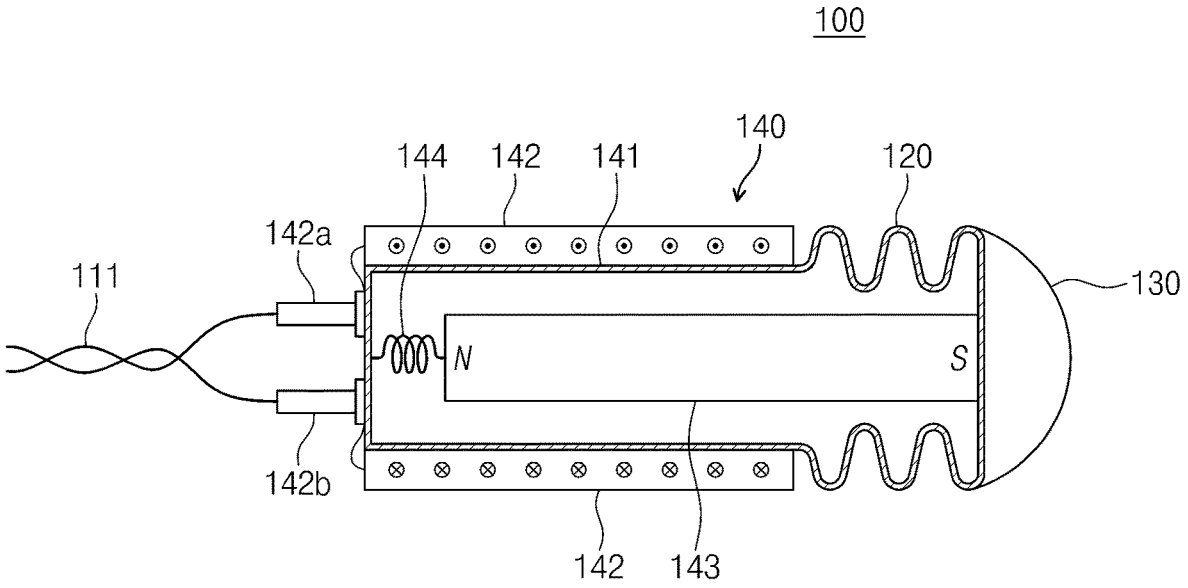
FIG. 11B is a cross-sectional view of a vibration transducer according to further another embodiment of the present invention.

FIG. 11B is a cross-sectional view of a vibration transducer according to further another embodiment of the present invention. The vibration transducer 100 illustrated in FIG. 11B is different from that of the embodiment illustrated in FIG. 11A in that an end of the magnet member 143 is directly in contact with the end side of the bellows member 120 without the connection member (see reference numeral 145 of FIG. 10A) to allow the vibration of the magnet member 143 to be directly transmitted to the connection member 130. The magnet member 143 may be provided with a magnet having two polarities as illustrated in FIG. 11B as well as a magnet having three polarities. Also, the coil part 142 may have a structure in which the coil is wound in one direction as well as a structure in which the coil changes in winding direction in three stages.

Although not shown, the vibration transducer according to further another embodiment may not include the elastic member 144. That is, the magnet member 143 may be connected to the end side of the bellows member 120 through the connection member in a state where shock is not absorbed by the elastic member 144 or directly connected to the end of the bellows member 120 to vibrate. Here, a guide member (not shown) for guiding the vibration of the magnet member 143 along a longitudinal direction may be disposed in the case 141.

Figure 12:
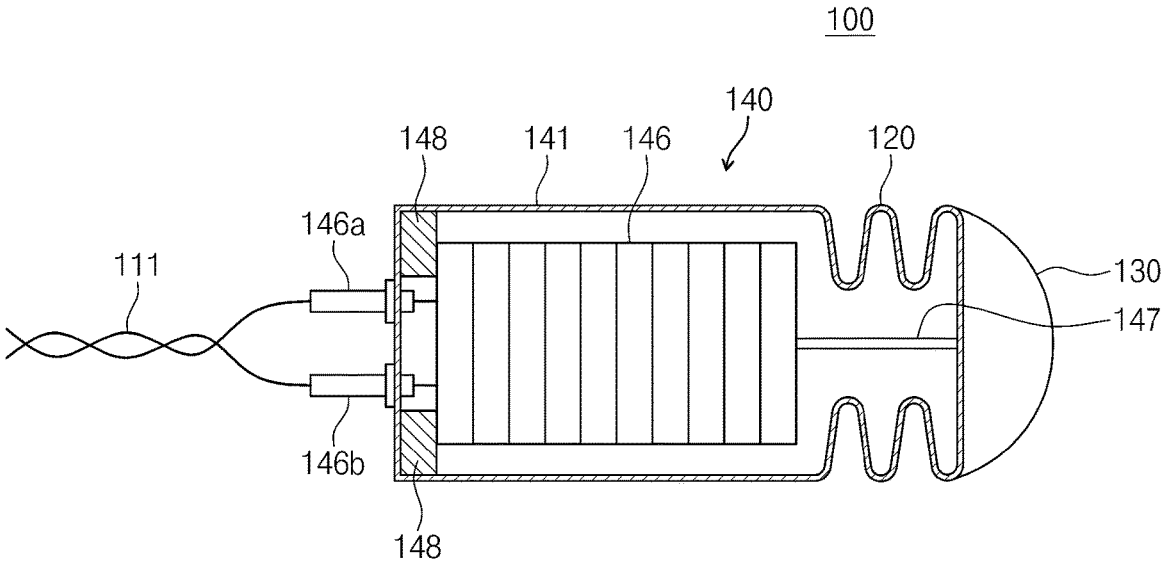
FIG. 12 is a cross-sectional view of a vibration transducer according to further another embodiment of the present invention.
Figure 13:
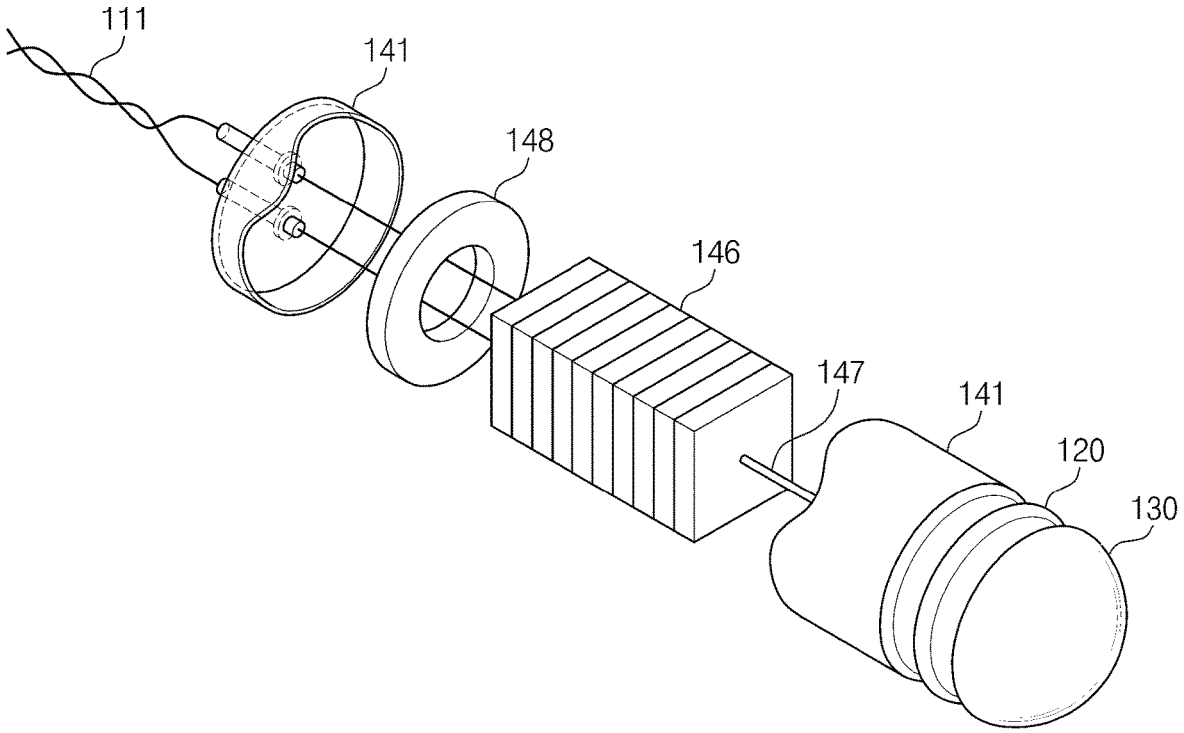
FIG. 13 is an exploded perspective view of the vibration transducer of FIG. 12.

FIG. 12 is a cross-sectional view of a vibration transducer according to further another embodiment of the present invention, and FIG. 13 is an exploded perspective view of the vibration transducer of FIG. 12. The embodiment illustrated in FIGS. 12 to 13 is different from the embodiment illustrated in FIGS. 8 to 10B in that the vibration generation part 140 is constituted by a piezoelectric vibration member 146 instead of the coil part and the magnet member. Referring to FIG. 12, the vibration generation part 140 includes the case 141 having a cylindrical shape, electrodes 146*a* and 146*b* disposed on the case 141, a piezoelectric vibration member 146, a connection member 147, and a buffer member 148. The electrodes 146*a* and 146*b* may input an electrical signal transmitted through the wire member 111 into the piezoelectric vibration member 146. The piezoelectric vibration member 146 may be disposed on the central axis of the cylindrical case 141 to generate vibration on the central axis by the electrical signal. The piezoelectric vibration member 146 may be provided with a single crystal or layered type. The buffer member 148 may have a ring shape such as a circle shape to buffer vibration of the piezoelectric vibration member 146. The connection member 147 may connect the piezoelectric vibration member 146 to the bellows member 120 so that the vibration of the piezoelectric vibration member 146 is transmitted to the bellows member 120. Here, the vibration of the magnet member 143 may be stably efficiently transmitted to the round window by a bellows structure of the bellows member 120.

Figure 14:
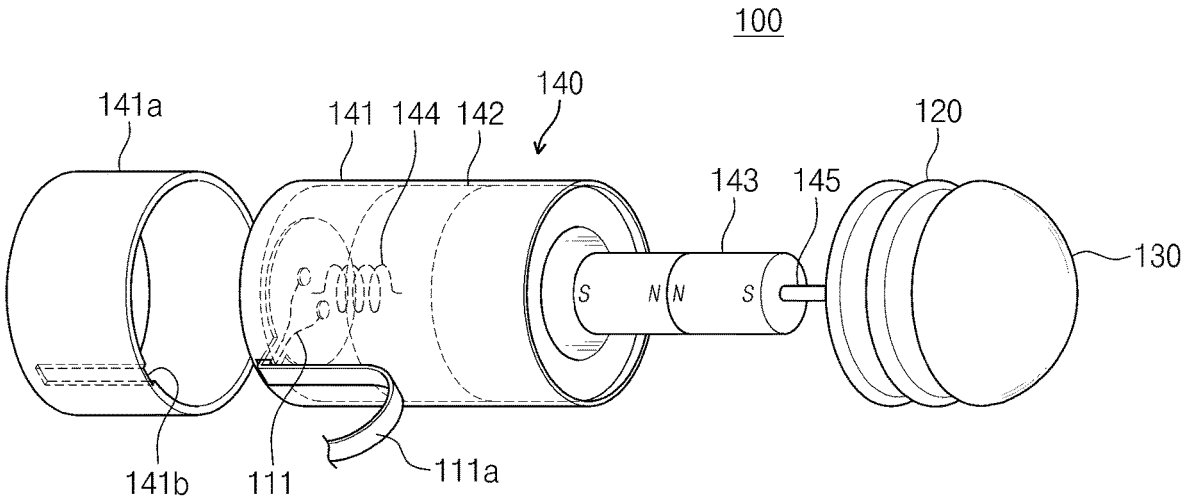
FIG. 14 is a perspective view of the vibration transducer according to further another embodiment of the present invention.
Figure 15:
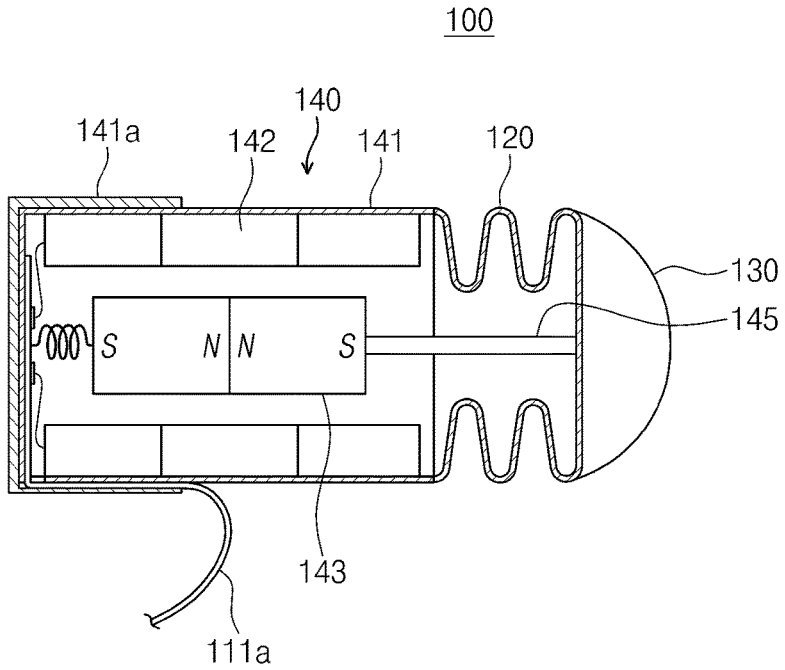
FIG. 15 is a cross-sectional view of the vibration transducer of FIG. 14.

FIG. 14 is a perspective view of the vibration transducer according to further another embodiment of the present invention, and FIG. 15 is a cross-sectional view of the vibration transducer of FIG. 14. The embodiment illustrated in FIGS. 14 to 15 is different from that illustrated in FIGS. 8 to 10 in that the vibration transducer has a structure in which an electrical signal is received through a lead wire 111*a* drawn through a side surface of the case 141 instead of the feed-through structure in which the electrical signal is received through the wire member passing through the end side of the cylindrical case 141. Referring to FIGS. 14 to 15, the lead wire 111*a* may be drawn through a lead hole defined in a lower end of the side surface of the case 141. Here, a cover 141*a* is coupled to the lower end of the case 141. The lead wire 111*a* may be formed of a flexible material such as polyimide. A lead groove 141*b* may be defined in an inner side surface of the cover 141*a* to allow the lead wire 111*a* to be inserted therein. According to the embodiment of the FIGS. 14 to 15, it may ensure sealability of a lead wire 111*a* portion.

According to the embodiments of the present invention, the vibration transducer may ensure sufficient vibration displacement and vibration characteristic by the bellows member even though a diaphragm does not increase in diameter. Thus, when the vibration transducer is implanted into the human body, the range of vision may be easily secured. The vibration transducer 100 according to the embodiments of the present invention may adjust the shape (the ratio of crest to trough, the pitch between the crests, and so on) of the bellows member 120 to ensure the desired vibration displacement and be precisely controlled in frequency characteristic. Also, since the vibration transducer 100 has the structure to easily ensure sealability and durability, the vibration transducer 100 may have characteristic suitable for the implantable hearing aid device.

According to the embodiments of the present invention, the vibration transducer may have sealability and small size to increase transmission efficiency of the vibration applied into the auditory tissue of the body.

Also, according to the embodiments of the present invention, limitations in which it is difficult to secure the range of vision because of the auditory ossicles and ligament, and also the vibrator itself is restricted in size and length may be resolved.

Also, according to the embodiments of the present invention, the vibration transducer may maintain excellent vibration characteristic with respect to the sound signals having various frequency bands.

Also, according to the embodiments of the present invention, the vibration transducer may be precisely controlled in frequency characteristic.

Effects of the present invention will not be limited to the above-described effects. Other effects not described herein will be clearly understood from the present disclosure and the accompanying drawings by those skilled in the art from descriptions below.

Foregoing embodiments give further detailed description to help understanding of the prevent invention, but do not limit the scope of the present invention. The real protective scope of the present invention shall be determined by the technical scope of the accompanying claims. Therefore, the scope of the invention is defined not by the detailed description of the invention but by the appended claims, and all differences within the scope will be construed as being included in the present invention.

What is claimed is:

1. An implantable hearing aid device comprising:

a signal processor implantable in a subject, the signal processor configured to process a signal from a microphone to output a sound signal;

a sound transmission tube configured for transmitting the sound signal to a round window of the subject;

a bellows member disposed at an end side of the sound transmission tube to transmit vibration due to the sound signal to the round window, the bellows member being devoid of liquid; and a vibration transmission member disposed at an end side of the bellows member, the vibration transmission member having a curved outer surface configured for receipt in the round window of the subject, wherein the vibration transmission member has a convex dome shape in an axial direction of the bellows member.

2. The implantable hearing aid device of claim 1, wherein the bellows member is configured to form longitudinal wave vibration in a central axis direction of the sound transmission tube to apply the vibration to the round window.

3. The implantable hearing aid device of claim 1, wherein the bellows member is formed of a biocompatible metal material or a silicone material.

4. The implantable hearing aid device of claim 1, wherein the bellows member comprises:

a plurality of crests; and a plurality of troughs, each trough being disposed between neighboring crests.

5. The implantable hearing aid device of claim 4, wherein the bellows member comprises a first bellows part and a second bellows part, each bellows part comprising the crests and troughs, a pitch of the first bellows part being different from a pitch of the second bellows part.

6. The implantable hearing aid device of claim 4, wherein the bellows member comprises a first bellows part and a second bellows part, each bellows part comprising the crests and troughs, a size of the crest of the first bellows part being different from a size of the crest of the second bellows part and/or a size of the trough of the first bellows part being different from a size of the trough of the second bellows part.

7. The implantable hearing aid device of claim 1, wherein the sound transmission tube includes:

a first end portion coupled to the signal processor; and a second end portion coupled to the bellows member.

8. A vibration transducer comprising:

a sound transmission tube implantable in a subject, the sound transmission tube having a passage through which a sound signal is transmitted;

a bellows member disposed at an end side of the sound transmission tube, the bellows member being devoid of liquid and configured for applying longitudinal wave vibration to auditory tissue of the subject according to the sound signal; and a vibration transmission member disposed at an end side of the bellows member, the vibration transmission member having a curved outer surface configured for receipt in a round window of the subject, wherein the vibration transmission member has a convex dome shape in an axial direction of the bellows member.

9. The vibration transducer of claim 8, wherein the sound transmission tube includes:

a first end portion configured to be coupled to a signal processor; and a second end portion coupled to the bellows member.

* * * * *